United States Patent [19]

Nakai et al.

[11] 4,295,440

[45] Oct. 20, 1981

[54] APPARATUS FOR CONTINUOUSLY COATING A SHEET MATERIAL CONCURRENTLY WITH A PLURALITY OF STRIPES

[75] Inventors: Shinzo Nakai, Tokyo; Chitomi Shimizu, Matsudo, both of Japan

[73] Assignee: Hiraoka & Co., Ltd., Tokyo, Japan

[21] Appl. No.: 124,948

[22] Filed: Feb. 26, 1980

[30] Foreign Application Priority Data

Feb. 28, 1979 [JP] Japan ..... 54-23101

[51] Int. Cl.[3] ..... B05C 3/18

[52] U.S. Cl. ..... 118/412; 118/415

[58] Field of Search ..... 118/411, 412, 415, 413, 118/407

[56] References Cited

U.S. PATENT DOCUMENTS

| | | | |
|---|---|---|---|
| 1,422,545 | 7/1922 | Dayton | 118/412 |
| 2,494,378 | 1/1950 | Dexter | 118/412 X |
| 2,526,991 | 10/1950 | Biddle | 118/412 |
| 2,695,005 | 11/1954 | Lewen et al. | 118/412 |
| 3,707,137 | 12/1972 | Jaworek | 118/415 |

*Primary Examiner*—John P. McIntosh

*Attorney, Agent, or Firm*—Benasutti Associates, Ltd.

[57] ABSTRACT

An apparatus for continuously coating a sheet material concurrently with a plurality of coating liquids in the pattern of a plurality of stripes, having a coating liquid-feeding device having a plurality of parallel compartments each defined by a pair of vertical partitioning plates and an inclined guide plate for introducing a coating liquid onto a portion of the sheet material, each partitioning plate having a bottom edge thereof having a profile in the form of an arc bulged downward from an imaginary straight line drawn between lowermost ends of both side edges of the partitioning plate.

11 Claims, 8 Drawing Figures

APPARATUS FOR CONTINUOUSLY COATING A SHEET MATERIAL CONCURRENTLY WITH A PLURALITY OF STRIPES

FIELD OF THE INVENTION

The present invention relates to an apparatus for continuously coating a sheet material concurrently with a plurality of coating liquids. More particularly, the present invention relates to an apparatus for continuously coating a sheet material, such as a fabric, concurrently with a plurality of coating liquids to form a pattern of a plurality of stripes, each of which is different in color from the neighbouring stripes, on the sheet material.

BACKGROUND OF THE INVENTION

It is known that a pattern of a plurality of stripes, each of which is different in color from the neighbouring ones, can be formed on a surface of a sheet material, such as a fabric or plastic film or sheet, by using an apparatus which comprises a pair of means for feeding a sheet material into the apparatus and for delivering the sheet material from the apparatus; a coating table arranged between the sheet material-feeding means and the sheet material-delivering means and having a horizontal, smooth upper surface along which the sheet material slides; a substantially vertical coating doctor knife having a blade which is formed in a lower end portion thereof and located above the coating table, and; a coating liquid-feeding device connected to the doctor knife and having a plurality of separate compartments through which a plurality of coating liquids are concurrently fed onto a surface of the sheet material. Each of the separate compartments is defined by a pair of vertical, rectangular partitioning plates which are placed upright and above the horizontal surface of the coating table, which are spaced from each other, in parallel to each other, and which are connected to each other by an inclined guide plate. A side edge of each partitioning plate is positioned in close contact with a surface of the doctor knife, at a right angle to the surface of the doctor knife. This side edge has a lowermost end positioned at the same level as that of a lowermost end of the blade of the doctor knife. The inclined guide plate is interposed between a pair of the partitioning plates and has an upper surface which obliquely-downwardly approaches the blade of the doctor knife. The lower end of the guide plate is spaced from the blade of the doctor knife and is located above the bottom edges of the partitioning plates. The bottom edge surface of each vertical, rectangular partitioning plate is oriented so that it is not parallel to the horizontal surface of the coating table.

When the above-mentioned apparatus is used, a sheet material is continuously moved from the sheet material-feeding means to the sheet material delivering means along the horizontal surface of the coating table, and the doctor knife and the coating liquid-feeding device are placed on the sheet material. During the coating operation, by using the above-mentioned apparatus, friction is created between the upper surface of the sheet material and the bottom edge surfaces of the partitioning plates, and between the lower surface of the sheet material and the horizontal upper surface of the coating table, which causes a tension to be created on the sheet material. However, the above-mentioned frictions are not only unevenly distributed on the sheet material, but also, irregularly vary during the coating operation. Uneven distribution and irregular variation of the friction on the sheet material result in uneven distribution of tension on the sheet material and in irregular variation of the tension during the coating operation. The uneven distribution and irregular variation of the tension on the sheet material causes the thickness of the layer of each coating liquid applied onto the surface of the sheet material to be uneven in distribution and to irregularly vary during the coating operation. Also, the sharpness of both side edge lines of each of the stripes formed by the coating liquids becomes poor. Furthermore, the uneven and irregularly varying tension on the sheet material causes the sheet material to become wrinkled during the coating operation.

Accordingly, it is strongly desired to elminate the above-mentioned disadvantages from the conventional apparatus.

SUMMARY OF THE INVENTION

An object of the present invention is to provide an apparatus for continuously coating a sheet material concurrently with a plurality of coating liquids to form a pattern of a plurality of stripes on the sheet material, which apparatus is capable of feeding the coating liquids evenly and constantly onto the sheet material during the coating operation.

Another object of the present invention is to provide an apparatus for continuously coating a sheet material concurrently with a plurality of coating liquids to form, on the sheet material, a pattern of a plurality of stripes, each having sharp side edge lines.

Still another object of the present invention is to provide an apparatus for continuously coating a sheet material concurrently with a plurality of coating liquids to form a pattern of a plurality of stripes on the sheet material, which apparatus is effective for preventing the formation of wrinkles on the sheet material during the coating operation.

The above-mentioned objects can be attained by the apparatus of the present invention which comprises:

(1) a pair of means for feeding a sheet material and for delivering the sheet material;

(2) a substantially vertical coating doctor knife having a blade formed in the lower end portion thereof and arranged between the sheet material-feeding means and the sheet material-delivering means; and (3) a coating liquid-feeding device attached to a front surface of the doctor knife, which surface faces the sheet material-feeding means, and having a plurality of parallel compartments, each of which compartments is defined by; (A) a pair of vertical partitioning plates which are parallel to each other, and spaced from each other, and which are connected to the front surface of the doctor knife at a right angle to the front surface of the doctor knife in such a manner that a side edge surface of each partitioning plate is in close contact with the front surface of the doctor knife, and a lowermost end of the side edge surface is located at substantially the same level as that of a lowermost end of the blade of the doctor knife, each of the partitioning plates including a bottom edge having a profile in the shape of an arc bulged downward from an imaginery straight line drawn between the lowermost ends of both side edges of the partitioning plate, and; (B) an inclined guide plate interposed between a pair of the partitioning plates and having an inclined upper surface which obliquely and downwardly approaches the blade of the doctor knife, and a lower end located close to the blade of the doctor knife and inside the bottom edges of a pair of the partitioning plates.

DETAILED DESCRIPTION OF THE INVENTION

The apparatus of the present invention is useful for continuously coating a sheet material, for example, a woven fabric, a knitted fabric, a non-woven fabric, or a paper or plastic film or sheet, concurrently with a plurality of coating liquids to form a plurality of stripes on the sheet material. The coating liquids may be the same as or different from each other. Usually, the resultant stripes are each different in color or brightness from the neighboring ones thereof.

Figure 1:
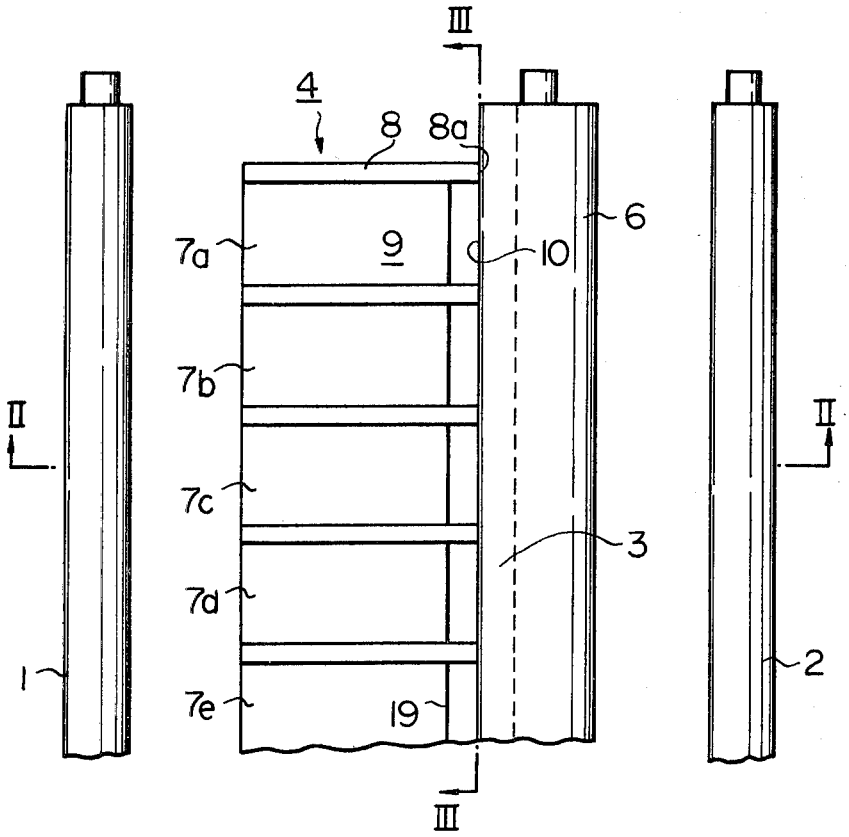
FIG. 1 shows an explanatory partial plan view of an embodiment of the apparatus of the present invention.
Figure 2:
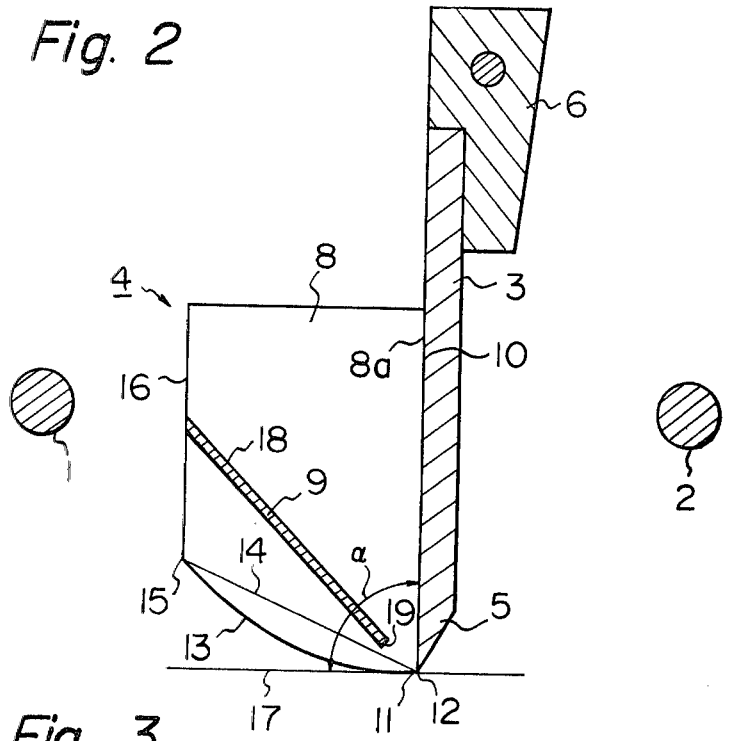
FIG. 2 shows a cross-sectional view of the apparatus indicated in FIG. 1 along line II—II.
Figure 3:
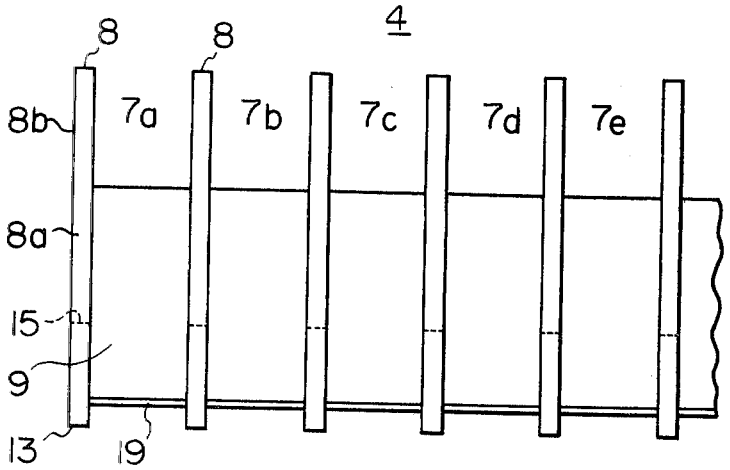
FIG. 3 shows a cross-sectional view of the apparatus indicated in FIG. 1 along line III—III.

Referring to FIGS. 1, 2 and 3, a continuous coating apparatus comprises a sheet material-feeding means 1, a sheet material-delivering means 2, a substantially vertical doctor knife 3 and a coating liquid-feeding device 4 attached to the doctor knife 3. Each of the sheet material-feeding and sheet material-delivering means 1 and 2 may be a single rotatable roller, a pair of nip rollers or a bar. Usually, the sheet material-delivering means 2 is a rotatable single roller capable of withdrawing the coated sheet material at a desired speed.

The doctor knife 3 is located between the sheet material-feeding and sheet material-delivering means 1 and 2 and has a blade 5 formed in the lower portion thereof. A front surface 10 of the doctor knife 3 faces the sheet material-feeding means 1 and is flat. An upper end portion of the doctor knife 3 is held by a holder 6.

The coating liquid-feeding device 4 is arranged between the sheet material-feeding means 1 and the doctor knife 3 and is attached to the front surface 10 of the doctor knife 3. The feeding device 4 has a plurality of parallel compartments *7a, 7b - - - 7e - - -*, through which a plurality of coating liquids are fed onto a surface of the sheet material. Each of the compartments is defined by a pair of vertical partitioning plates 8 and an inclined guide plate 9.

The vertical partitioning plates 8 are parallel to each other, and are spaced from each other, and are connected to the front surface 10 of the doctor knife 3 at a right angle to the front surface in such a manner that a side edge surface *8a* of each partitioning plate 8 is in close contact with the front surface 10 of the doctor knife 3 and a lowermost end 11 of the side edge surface *8a* is located at the same level as that of a lowermost end 12 of the blade 5 of the doctor knife 3.

In the apparatus of the present invention, it is essential that the profile of the bottom edge 13 of each partitioning plate is in the shape of an arc bulged downwardly from an imginary straight line 14 drawn between the lowermost end 11 of the side edge *8a* and a lowermost end 15 of the other side edge 16 of each partitioning plate 8. This feature is effective in causing the tension created on the sheet material during the coating operation to be even and constant. The even and constant tension on the sheet material is effective in forming uniform stripes of the coating liquids on the sheet material. Also, the above-mentioned even and constant tension created on the sheet material is effective in preventing the formation of wrinkles on the sheet material during the coating operation.

Usually, it is preferable that (referring to FIG. 2) an angle $\alpha$ between the front surface 10 of the doctor knife 3 and an imaginary tangential line 17 of the arc 13 drawn at the lowermost end 11 of the side edge *8a* of the partitioning plate 8 is in a range of from 90 to 45 degrees, more preferably, from 85 to 60 degrees. The angle $\alpha$ may be varied in accordance with the desired thickness of the layer of each coating liquid applied onto the sheet material. However, the angle $\alpha$ in the above-mentioned range is effective for improving the uniformity of the stripes formed on the sheet material and for promoting the sharpness of the side edge lines of the resultant stripes.

Also, it is preferable that the lowermost end 11 of the side edge surface *8a* of each partitioning plate 8 contacting the front surface 10 of the doctor knife 3 be located below the level of the lowermost end 15 of the other side edge surface 16 of the partitioning plate 8. This feature is effective for promoting close contact of the bottom edge surface 13 of the partitioning plate 8 with the sheet material.

The inclined guide plate 9 is interposed between a pair of the partitioning plates 8 so as to be connected to the partitioning plate 8 at both side edge surfaces. The guide plate 9 has an inclined upper surface 18 which obliquely and downwardly approaches the blade 5 of the doctor knife 3. A lower end 19 of the guide plate 9 is located close to the blade 5 of the doctor knife 3 and inside the bottom edges 13 of the partitioning plates 8. The inclined upper surface 18 is effective for receiving and introducing the coating liquid along the upper surface 18. Also, the lower end 19 is effective for feeding the coating liquid onto a portion of the sheet material close to the blade 5 of the doctor knife 3.

Figure 4:
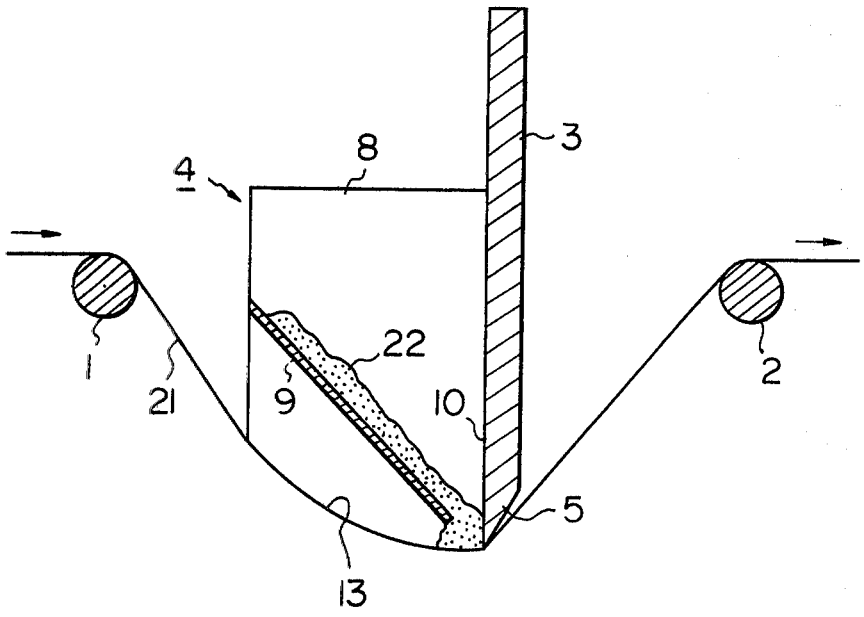
FIG. 4 shows a cross-sectional view which illustrates a coating operation using the apparatus indicated in FIGS. 1, 2 and 3.

When the apparatus indicated in FIGS. 1, 2 and 3 is used for coating a sheet material (referring to FIG. 4) a sheet material 21 is fed through the feeding means 1, coated with a plurality of coating liquids 22 by means of the coating liquid-feeding device 4 and the doctor knife 3, and finally, delivered through the delivering means 2. When traveling between the sheet material-feeding and sheet material-delivering means 1 and 2, the upper surface of the sheet material 21 is brought into contact with a plurality of the bottom edge surfaces 13 of the partitioning plates 8 which are spaced from each other, and slides along the arc-profiled bottom edge surfaces 13 so as to create a proper tension on the sheet material 21.

This tension is created constantly during the coating operation, and is evenly distributed on the sheet material 21.

Each of the coating liquids 22 are fed from a corresponding supply source (not shown in the drawing) and onto the guide plate 9. Each coating liquid 22 flows down along the upper surface of the guide plate 9 and is fed onto a portion of the upper surface of the sheet material 21 positioned in front of the front surface 10 of the doctor knife 3. Each coating liquid 22 being applied on the portion of the sheet material in front of the doctor knife 3 is separated from the neighbouring ones by the partitioning plates 8. Also, the bottom edge surface 13 of each partitioning plate is in close contact with the upper surface of the sheet material so as to prevent undesirable penetration of the coating liquid into the portion of the sheet material 21 which is contacted by the bottom edge surface 13 of the partitioning plate 8. Therefore, the resultant stripes of the coating liquid have very sharp side edge lines.

The coating liquid-feeding device 4 may be detachably connected to the front surface of the doctor knife. However, it is preferable that the doctor knife is bonded to the coating liquid-feeding device so that the location of the lower end of the blade of the doctor knife is fixed at a desired level.

In the apparatus of the present invention, the bottom edge surface of the partitioning plate may be at a right angle to both side surfaces of the partitioning plate. Referring to FIG. 3, each partitioning plate 8 has a bottom edge surface 13 which is at a right angle to both side surfaces of the partitioning plate. Therefore, when the sheet material is brought into contact with the bottom edge of each partitioning plate, the entire area of the bottom edge surface can contact the sheet material. In this case, the resultant coated sheet material has a plurality of stripes which correspond to the bottom edge surfaces and which are coated with no coating liquid.

Figure 6:
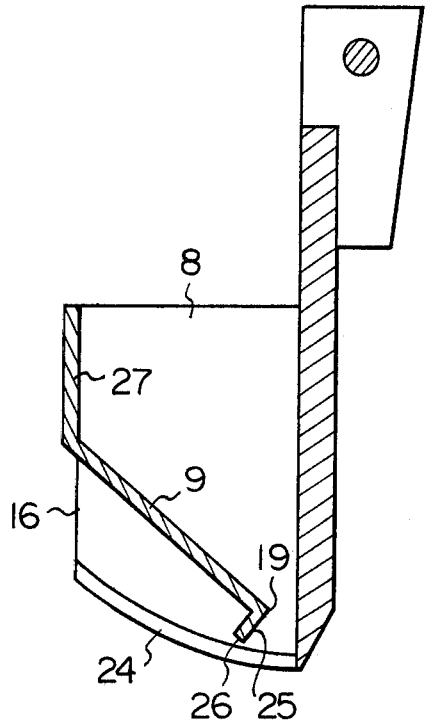
FIG. 6 shows a cross-sectional view of the coating liquid-feeding device attached to the doctor knife of the apparatus indicated in FIG. 5 along line V—V.
Figure 7:
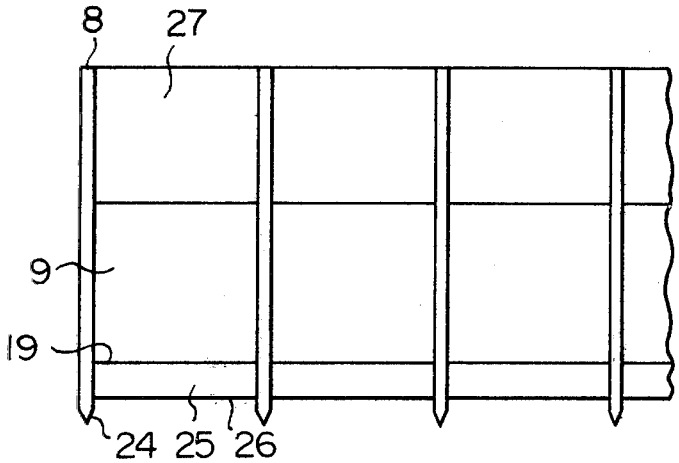
FIG. 7 shows a cross-sectional view of the coating liquid-feeding device indicated in FIG. 5 along line VI—VI.

In the apparatus of the present invention, the bottom edge portions of the partitioning plates may be tapered, so as to form sharpened edges of the partitioning plates. Referring to FIGS. 6 and 7, the bottom edge portion of each partitioning plate 8 is tapered to form a sharpened edge 24. The sharpened edge 24 is effective in forming a stripe of the coating liquid which is closely connected to the neighboring stripes and which exhibits very sharp side edge lines.

Also, in the apparatus of the present invention, the lower end of the guide plate in each compartment may be connected to an upper end of an additional, downwardly extending guide plate. The additional guide plate has a lower end thereof located inside the bottom edges of the partitioning plates between which the additional guide plate is interposed. The additional guide plate is effective for smoothly feeding the coating liquid onto the desired portion of the sheet material surface.

Figure 5:
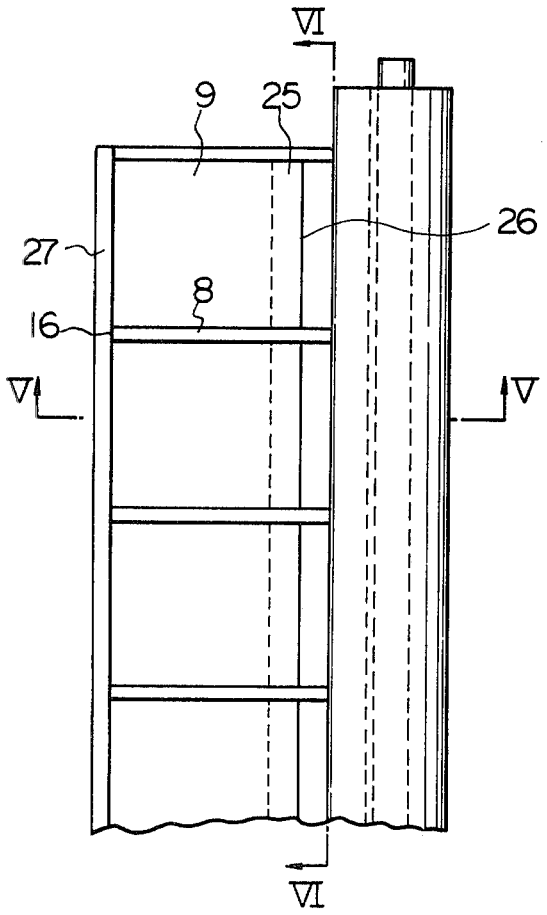
FIG. 5 shows an explanatory partial plan view of a coating liquid-feeding device attached to a doctor knife in another embodiment of the apparatus of the present invention.

In a preferred embodiment of the additional guide plate, the location of the lower end of the additional guide plate is farther from the front surface of the doctor knife than that of the lower end of the guide plate. Referring to FIGS. 5, 6 and 7, the lower end 19 of the guide plate 9 is connected to an upper end of an additional guide plate 25 in each compartment. The additional guide plate 25 extends downwardly and has a lower end 26 which is located farther from the front surface 10 of the doctor knife 3 than the lower end 19 of the guide plate 9. The above-mentioned type of additional guide plate is effective for smoothly feeding the coating liquid to a portion of the sheet material surface located far from the blade of the doctor knife. This activity of the additional guide plate is effective for increasing the area of the sheet material covered by the coating liquid before reaching the doctor knife and, therefore, for promoting the uniform coating of the sheet material.

Furthermore, in the apparatus of the present invention, each compartment may have a back plate connected to an upper end of the guide plate and to the side edge portions of the partitioning plates. Referring to FIGS. 5, 6 and 7, a back plate 27 is connected at both side edges to the side edge surfaces 16 of a pair of the partitioning plate 8. Also, the upper end of the guide plate 9 is connected to the back plate 27. The back plate is effective in reinforcing the coating liquid-feeding device and, also, for preventing overflow of the coating liquid through the upper end of the guide plate.

Figure 8:
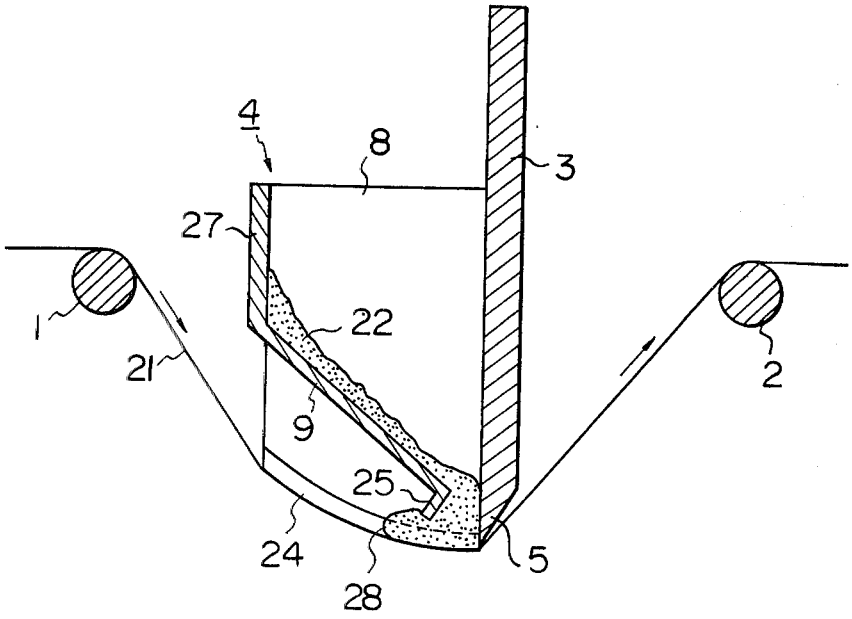
FIG. 8 shows a cross-sectional view which illustrates a coating operation using the apparatus indicated in FIGS. 5, 6 and 7.

Referring to FIG. 8, when the apparatus indicated in FIGS. 5, 6 and 7 is used for coating the sheet material to form a pattern of a plurality of stripes of the coating liquids, the back plate 27 prevents the overflow of the coating liquid through the upper end of the guide plate 9, the additional guide plate 25 allows the coating liquid to flow to a location 28 far from the blade 5 of the doctor knife 3, and the sharpened bottom edge of the partitioning plate 8 allows the resultant stripe of the coating liquid to closely connect to the neighbouring stripes.

What we claim is:

1. An apparatus for continuously coating a sheet material concurrently with a plurality of coating liquids in the pattern of a plurality of stripes, which apparatus comprises:

(1) means for feeding a sheet material and means for delivering said sheet material;

(2) a substantially vertical coating doctor knife having a blade formed in the lower end portion thereof and arranged between the sheet material-feeding means and the sheet material-delivering means, and;

(3) a coating liquid-feeding device attached to a front surface of said doctor knife, which front surface faces said sheet material-feeding means, and having a plurality of compartments, each of which compartments is defined by:

(A) a pair of substantially vertical partitioning plates which are parallel to each other, spaced from each other and connected to the front surface of said doctor knife in such a manner that a side edge surface of each partitioning plate is in close contact with the front surface of the doctor knife, and a lowermost end of the side edge surface is at substantially the same level as that of a lowermost end of the blade of said doctor knife, and each of which partitioning plates has a bottom edge thereof having a profile in the shape of an arc bulged downwardly from an imaginary straight line drawn between the lowermost end of the side edge of said partitioning plate adjacent the doctor knife, and a lowermost end of another side edge of said partitioning plate, and;

(B) an inclined guide plate interposed between said pair of partitioning plates and having an inclined upper surface thereof obliquely, downwardly approaching the blade of said doctor knife, and a lower end thereof located close to the blade of said doctor knife, said guide plate also having a lower surface located inside the bottom edges of said pair of partitioning plates.

2. An apparatus as claimed in claim 1, wherein an angle $\alpha$, between the front surface of said doctor knife and an imaginary line tangential to said arc and extending from an end point of said arc contacting the front surface of said doctor knife, is in a range of from 90 to 45 degrees.

3. An apparatus as claimed in claim 2, wherein said angle $\alpha$ is in a range of from 85 to 60 degrees.

4. An apparatus as claimed in claim 1, wherein the location of an end point of said arc contacting the front surface of said doctor knife is below the level of the other end point of said arc.

5. An apparatus as claimed in claim 1, wherein the bottom edge surface of each partitioning plate is at a right angle to the side surface of the partitioning plate.

6. An apparatus as claimed in claim 1, wherein the bottom edge surface of each partitioning plate is tapered to form a sharpened edge.

7. An apparatus as claimed in claim 1, wherein the lower end of said guide plate is connected to an upper end of an additional, downwardly extending guide plate, which additional guide plate has a lower end located inside the bottom edges of said pair of partitioning plates.

8. An apparatus as claimed in claim 1, wherein each compartment has a back plate connected to the upper end of said guide plate and said side edge portions of said pair of partitioning plates.

9. An apparatus as claimed in claim 1, wherein said doctor knife is bonded to said coating liquid-feeding device.

10. An apparatus for continuously coating a sheet material concurrently with a plurality of coating liquids in the pattern of a plurality of stripes, which apparatus comprises:

(1) means for feeding a sheet material and means for delivering said sheet material;

(2) a substantially vertical coating doctor knife having a blade formed in the lower end portion thereof and arranged between the sheet material-feeding means and the sheet material-delivering means, and;

(3) a coating liquid-feeding device attached to a front surface of said doctor knife, which front surface faces said sheet material-feeding means, and having a plurality of compartments, each of which compartments is defined by:

(A) a pair of substantially vertical partitioning plates which are parallel to each other, spaced from each other and connected to the front surface of said doctor knife in such a manner that a side edge surface of each partitioning plate is in close contact with the front surface of the doctor knife, and a lowermost end of the side edge surface is at substantially the same level as that of a lowermost end of the blade of said doctor knife, and each of which partitioning plates has a bottom edge thereof having a profile in the shape of an arc bulged downwardly from an imaginary straight line drawn between the lowermost end of the side edge of said partitioning plate adjacent the doctor knife, and a lowermost end of another side edge of said partitioning plate;

(B) an inclined guide plate interposed between said pair of partitioning plates and having an inclined upper surface which obliquely, downwardly approaches the blade of said doctor knife, and a lower end which is located close to the blade of said doctor knife and inside the bottom edges of said pair of partitioning plates, and;

(C) an additional, downwardly extending guide plate, an upper end of which is connected to the lower end of said guide plate so that a lower end of said additional guide plate is located inside the bottom edges of said pair of partitioning plates, and so that the location of the lower end of said additional guide plate is farther from the front surface of said doctor knife than that of the lower end of said guide plate.

11. An apparatus for continuously coating a sheet material concurrently with a plurality of coating liquids in the pattern of a plurality of stripes, which apparatus comprises:

(1) means for feeding a sheet material and means for delivering said sheet material;

(2) a substantially vertical coating doctor knife having a blade formed in the lower end portion thereof and arranged between the sheet material-feeding means and the sheet material-delivering means, and;

(3) a coating liquid-feeding device attached to a front surface of said doctor knife, which front surface faces said sheet material-feeding means, and having a plurality of compartments, each of which compartments is defined by:

(A) a pair of substantially vertical partitioning plates which are spaced from each other, and connected to the front surface of said doctor knife in such a manner that a side edge surface of each partitioning plate is in close contact with the front surface of the doctor knife, and a lowermost end of the side edge surface is at substantially the same level as that of a lowermost end of the blade of said doctor knife, wherein each of said partitioning plates includes a bottom edge having a profile in the shape of an arc bulged downwardly from an imaginary straight line drawn between the lowermost end of the side edge of said partitioning plate adjacent the doctor knife, and a lowermost end of an opposing side edge of said partitioning plate, and;

(B) an inclined guide plate interposed between said pair of partitioning plates and having an inclined upper surface which obliquely, downwardly approaches the blade of said doctor knife, and a lower end which is located close to the blade of said doctor knife and inside the bottom edges of said pair of partitioning plates;

so that the only portions of the coating liquid-feeding device which contact said sheet material are the arc-shaped bottom edges of the partitioning plates.

* * * * *